US005442528A

United States Patent [19]

Vandenbelt

[11] Patent Number: 5,442,528

[45] Date of Patent: Aug. 15, 1995

[54] LIGHTING DEVICE WITH NOVEL NECK MECHANISM

[76] Inventor: Rudy A. Vandenbelt, 1705 Abbey Rd., Ottawa, Ontario, Canada, K1G 0H2

[21] Appl. No.: 176,580

[22] Filed: Dec. 30, 1993

[51] Int. Cl.[6] ..... A47B 19/00

[52] U.S. Cl. ..... 362/98; 362/198; 362/287; 362/288

[58] Field of Search ..... 362/98, 99, 198, 285, 362/287, 288, 418

[56] References Cited

U.S. PATENT DOCUMENTS

| | | | |
|---|---|---|---|
| 1,768,733 | 7/1930 | Beckett | 362/98 |
| 2,299,008 | 10/1942 | De Lisle | 362/98 |
| 4,432,042 | 2/1984 | Zeller | 362/183 |
| 4,598,340 | 7/1986 | Dwosh et al. | 362/98 |
| 4,680,681 | 7/1987 | Fisherman et al. | 362/98 |
| 5,176,438 | 1/1993 | Fisherman | 362/99 |
| 5,203,622 | 4/1993 | Sottile | 362/198 |
| 5,280,416 | 1/1994 | Hartley et al. | 362/287 |

FOREIGN PATENT DOCUMENTS

| | | | |
|---|---|---|---|
| 294325 | 9/1916 | Germany | 362/198 |

*Primary Examiner*—Carl D. Price
*Assistant Examiner*—L. Heyman
*Attorney, Agent, or Firm*—Pennie & Edmonds

[57] ABSTRACT

A lighting device characterized by its light weight and ease of handling. One application of the lighting device is a lighted bookmark which can be placed between the pages of a book and also functions as a portable book light while reading. The invention utilizes a novel neck mechanism possessing a memory effect that repeatedly returns the light-bearing neck to its original curved position when extended. The light-bearing neck of the bookmark can be retracted to fit within the body of the bookmark and can also be pushed to extend out of the bookmark, causing the light to automatically energize above the pages of a book when reading. The novel light-bearing neck mechanism can be successfully incorporated into other lighting devices such as a lighted notepad and the like.

13 Claims, 5 Drawing Sheets

LIGHTING DEVICE WITH NOVEL NECK MECHANISM

BACKGROUND OF THE INVENTION

1. Field of the Invention

The present invention relates to a portable lighting device and more particularly to a light that enables the device to be simple, portable, and relatively inexpensive. The invention utilizes a novel neck mechanism possessing a memory effect that repeatedly returns the light-bearing neck to its original curved position when extended. Our application for the invention is in a bookmark-type light permitting the user to illuminate a small area such as the page of a book. This application of the invention can conveniently provide a source of light for reading during travel or otherwise, when a source of light is not readily available, and also permits reading in any position. The novel light-bearing neck mechanism can be successfully incorporated into other products such as a lighted notepad and the like and is also applicable to fixed (i.e., non-portable) installations.

2. Description of the Prior Art

The prior art describes a number of portable light sources (U.S. Pat. Nos. 4,432,042 and 4,598,340) as well as book covers (U.S. Pat. No. 4,680,681) and clipboards (U.S. Pat. No. 5,176,438) provided with reading lights. Typically, small desk lamps or pin-light lamps are well known and require a resting surface, such as a desk. Further improvement of these lamps permits them to be clamped to the binding of a book or the headrest of a bed. These versions are not easily portable and often require a source of electricity as well. Small portable book lights of light weight that can be entirely attached to a book or magazine are also known. U.S. Pat. No. 4,680,681 describes a book cover and reading light combination wherein the reading light is located at the end of a supporting arm which can be pulled out from (for use) or pushed into (for storage) the book cover housing. The supporting arm includes flexible sections which permit the arm to be moved and adjusted to any position over the book.

SUMMARY OF THE INVENTION

None of these patents disclose how to provide in such a lighting device, a neck mechanism capable of returning automatically to its desired extended position each time it is extended. The novel neck mechanism disclosed herein which possesses a memory that repeatedly returns the light-bearing neck to its original curved position when extended. While suggestions have previously been made to provide such a capability, no one has suggested a way to achieve that functionality as described herein. Therefore, the light-bearing neck always returns to a convenient curved position, thus illuminating the page, after having been laid flat when retracted into the base. The neck mechanism can be readily incorporated in other book, notepad, and other lighted devices as well. The light mechanism of the invention may moreover be automatically turned on and off by sliding the light-bearing neck along the length of the base, in the embodiment shown, a bookmark. Alternatively, the light mechanism may be energized or deenergized by simply pulling out, or pushing in, the neck into the bookmark. The lighted bookmark does not use any clips, and instead relies on rubber pads, a tapered body, and the gravity of the batteries to keep the bookmark in position while reading. It also can be used to mark the reader's page, while on a night stand, and is always ready for convenient night reading at a desk or in bed. The battery pack which powers the bookmark is easily removable and can also be a rechargeable unit. Alternatively, the battery pack can be substituted by an AC power supply. The lamp assembly itself can be rotated or swiveled in position to provide light where needed, and consists of a replaceable lamp cartridge and a vacuum metallized compound parabolic reflector. Finally, the bookmark travels naturally while stored in a book and is therefore very convenient and portable.

It is an object of this invention to provide a lighted bookmark that is elegant, light weight, portable, easy to use, and capable of extending to a curved predetermined position.

It is an object of this invention to provide a bookmark fitted with an unobtrusive light that illuminates only a small area without the need for any external source of electricity.

It is an object of this invention to provide a lighted bookmark that permits reading in any position without any external source of electricity.

It is an object of this invention to provide a lighted bookmark that marks the reader's page while the book is closed, as on a night stand, and is thus conveniently ready for night reading at any time.

It is an object of this invention to provide a removable battery unit with the bookmark that may be a AC rechargeable battery unit as well.

It is an object of this invention to provide a light-bearing neck member that can be retracted into the bookmark and be pushed out of the bookmark such that it automatically assumes a curved shape in the latter position, yet all the while provides an electrical path through the neck to the light at its end.

It is an object of this invention to provide a light-bearing neck member which automatically energizes a light when it is fully extended in its curved position and which deenergizes the light when it is pushed into the bookmark.

It is an object of this invention to provide a lighted bookmark that does not use any clips to hold it in position and instead relies on rubber pads, a tapered body design, and the gravity of the batteries to keep it in position.

It is an object of this invention to provide a bookmark fitted with a light that can be rotated or swiveled to adjust the direction and amount of light incident on the reading surface.

It is an object of this invention to provide a bookmark with a superior lamp assembly consisting of a replaceable lamp cartridge and a vacuum metallized compound parabolic reflector.

It is an object of this invention to provide a lighted bookmark that is naturally stored in a book and hence travels easily along with any reading material.

It is an object of this invention to provide a simple and relatively inexpensive lighted bookmark.

DETAILED DESCRIPTION OF THE INVENTION

Although a specific embodiment of this invention will now be discussed with particular reference to the drawings, it should be understood that such an embodiment is by way of example only and is illustrative of the many applications of the basic principles of this invention. Changes and modifications obvious to one skilled in the art are deemed to be within the scope of this invention as further defined in the claims. In particular, it is important to point out that incorporating the light-bearing neck mechanism with its novel memory effect in other book, notepad, and other lighted devices is contemplated and deemed to be within the scope of this invention.

Figure 1:
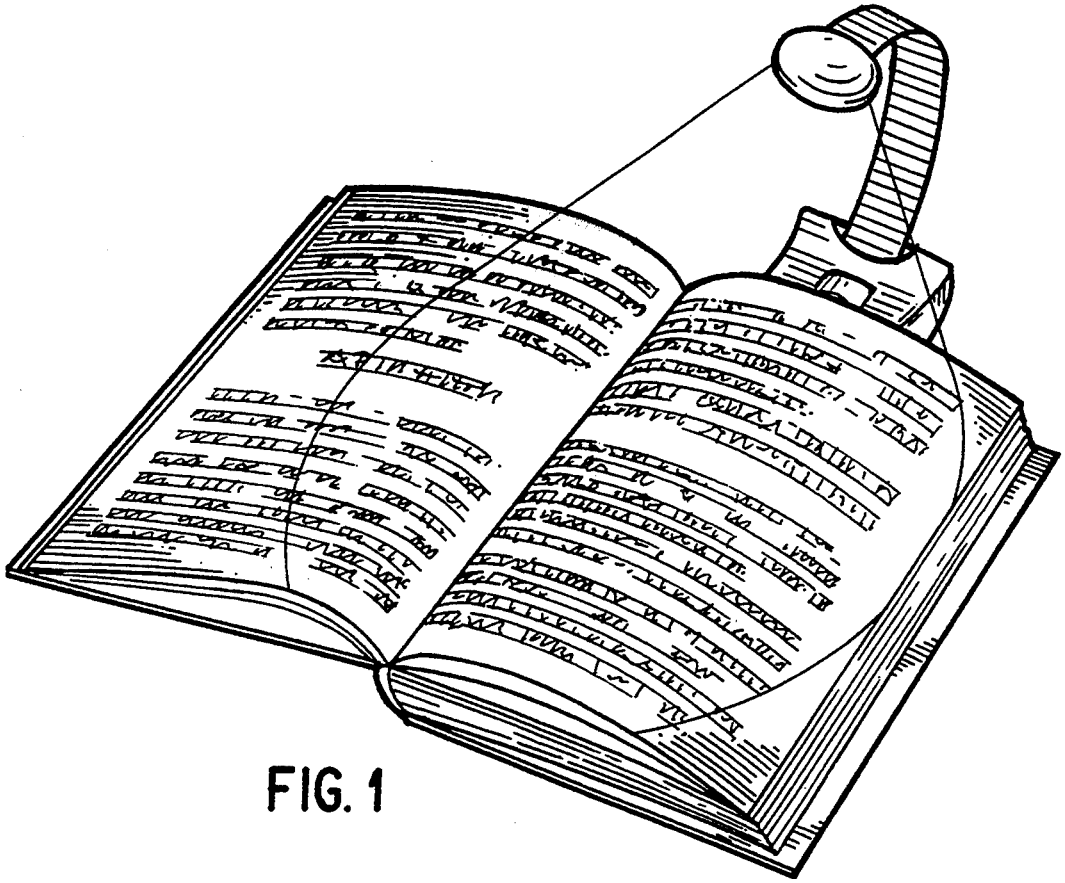
FIG. 1 is a perspective view of the lighted bookmark while in use with the light-bearing neck in its extended position illuminating the page being read.
Figure 2:
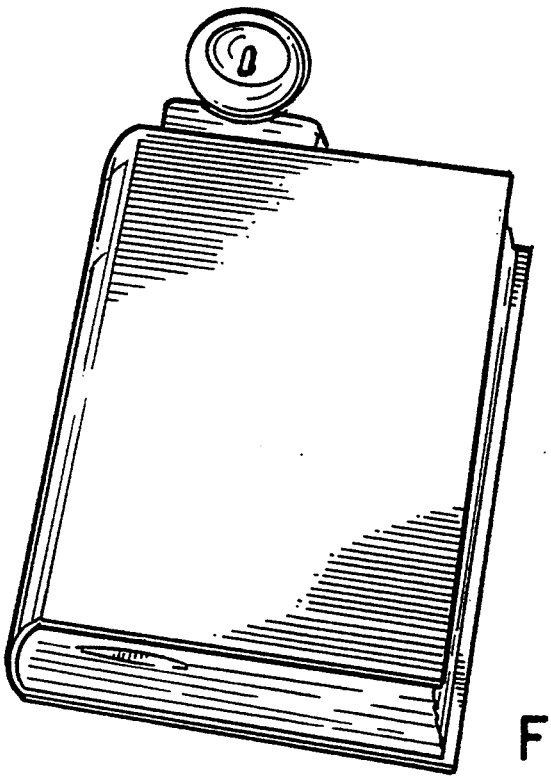
FIG. 2 is a perspective view of the lighted bookmark as stored in a book showing the light-bearing neck in its retracted position within the bookmark.

Referring now to the drawings, FIG. 1 illustrates the lighted bookmark of the present invention in operation. The bookmark provides a convenient and close direct source of light for the reader. It can be used either to read at a table or while reclining in a chair with an unobtrusive light that illuminates only a small area or while travelling in a vehicle or an airplane. FIG. 2 shows the present invention when not in use for reading but now functioning as an elegant bookmark. In this position it is easy to see why the lighted bookmark travels naturally with any reading material.

Figure 3:
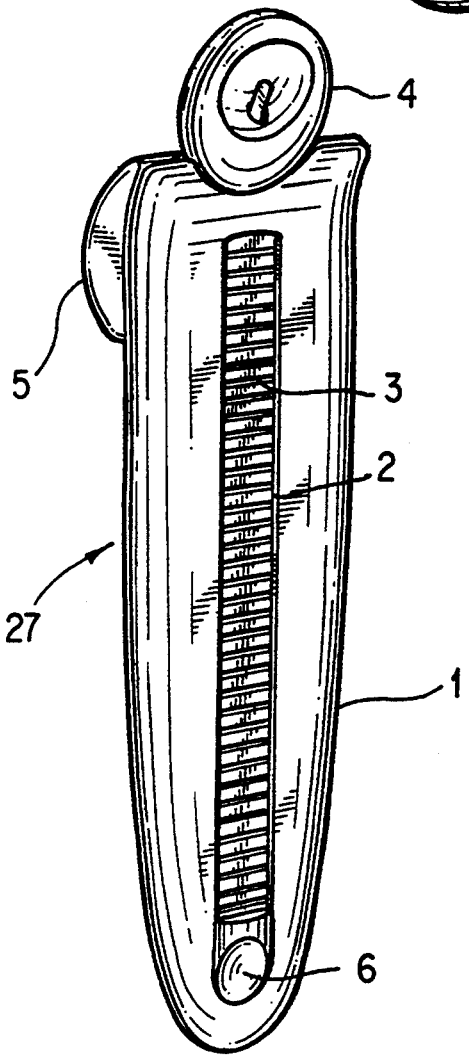
FIG. 3 is a side elevational view of the lighted bookmark with the neck in the retracted position.
Figure 4:
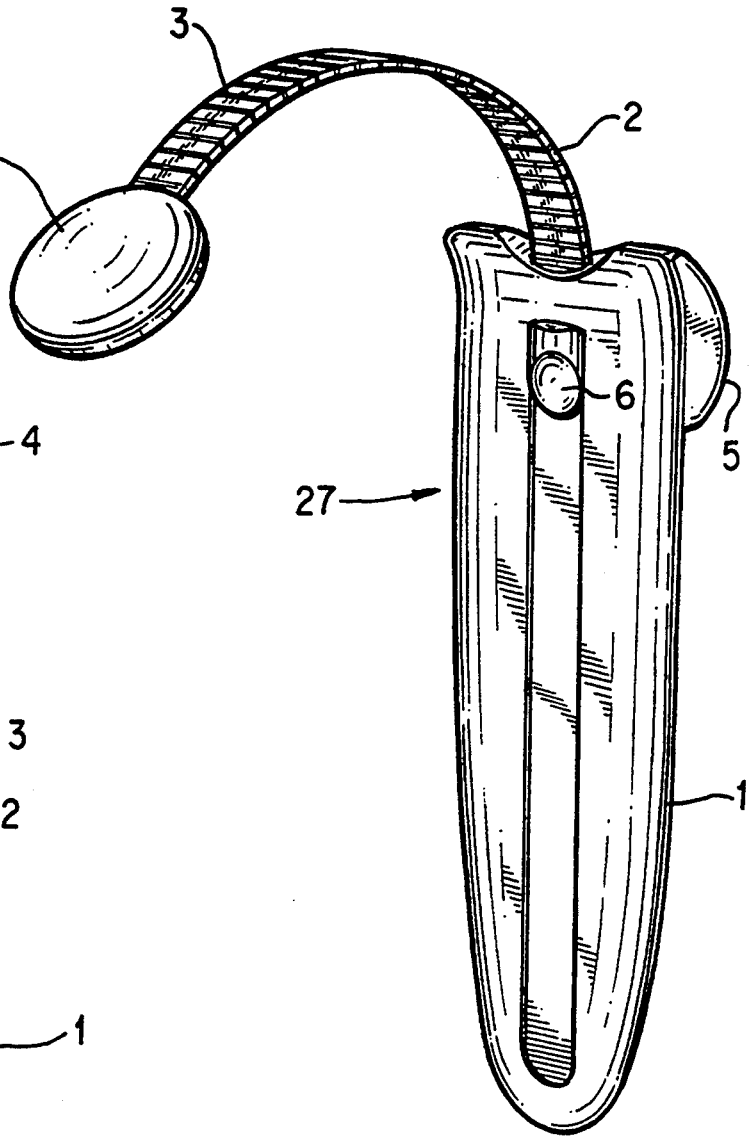
FIG. 4 is a side elevational view of the lighted bookmark with the neck being extended and showing the position of the battery pack.
Figure 8:
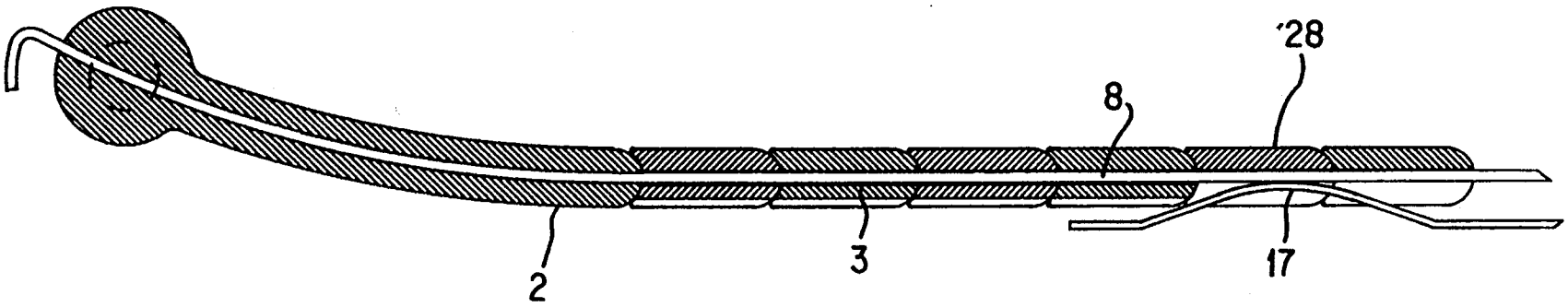
FIG. 8 is a vertical cross-section through the light-bearing neck in its extended position showing the individual vertebrae, the metal strips running through the neck and the passive switch mechanism. The passive switch depicts the electrical contact between the metal strips and the battery contact through the half vertebrae at the base of the neck when the neck is in the extended position.

FIG. 3 shows a side elevational view of the lighted bookmark 27 with the light-bearing neck 2 in the retracted position. As shown in FIG. 3 the neck 2 is made up of a plurality of individual vertebrae 3 strung together linearly on longitudinal electrically conductive members 8, the members preferably being pre-curved spring stainless steel strips. The term "vertebrae" is used to describe vertebrae like stacked segments. The individual vertebrae segments 3 are made of insulating material, preferably, a resilient plastic. The light-bearing neck 2 can be pushed in and out of the base 1 of the bookmark 27 by moving the button 6 at the bottom end of the neck 2, or alternatively by simply pulling it out from the lamp end. In this position the lamp 4 is turned off since there is no electrical connection between the battery pack 5 and the lamp assembly 4. As shown in FIG. 4, when the neck 2 is pushed out of the base 1 of the bookmark 27, the neck naturally curves inward due to the precurved spring stainless steel metal strips 8 the neck. Therefore, the light-bearing neck 2 is flat in its retracted position in FIG. 3 and curved in the extended position in FIG. 4 and retains its shape with repeated operation over a period of time. In essence, this invention provides a memory effect in the operation of the neck with the result that the neck always returns back to its curved position when extended out after having been laid flat when retracted into the bookmark. When the bookmark is in operation as shown in FIG. 4, the lamp is turned on since there is electrical contact between the metal strips 8 in the neck 2, shown in FIGS. 5 and 8, and the battery contacts 21 and 22. As shown in FIG. 8, when the neck is in the extended position, the battery contacts are electrically connected to the metal strips 8 through the half vertebrae 28 in the base of the neck 2 and form the passive switch 17 in FIG. 8. Now, when the neck 2 is retracted into the bookmark 27 the battery contacts 21 and 22 come up against the complete vertebrae 3 in the neck, and hence there is no electrical connection to the metal strips 8. As a result the passive switch mechanism 17 operates to turn the light off when the neck is retracted. The strips 8 thus serve the dual function of providing the shape necessary for the neck and providing current to the lamp, at the same time affording a way to string together the plastic neck vertebraes resulting in a strong, light weight, inexpensive, reliable structure with the properties described above.

Figure 7:
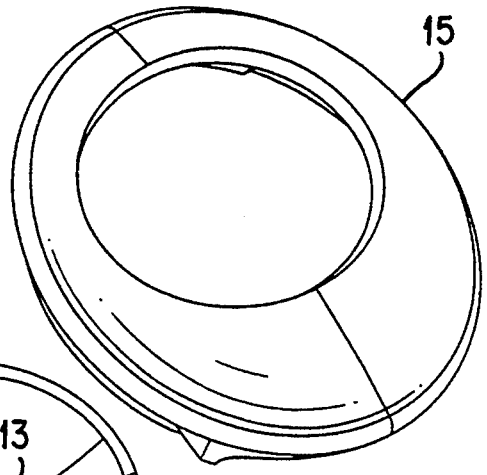
FIG. 7 is a perspective view of the lamp head cover.
Figure 6:
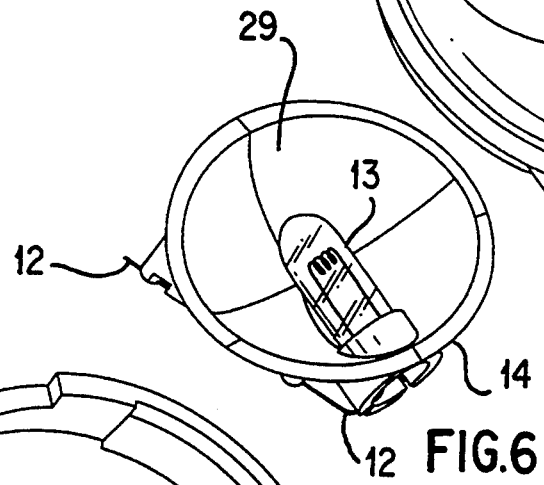
FIG. 6 is a perspective view of the parabolic reflector and the lamp cartridge assembly.
Figure 5:
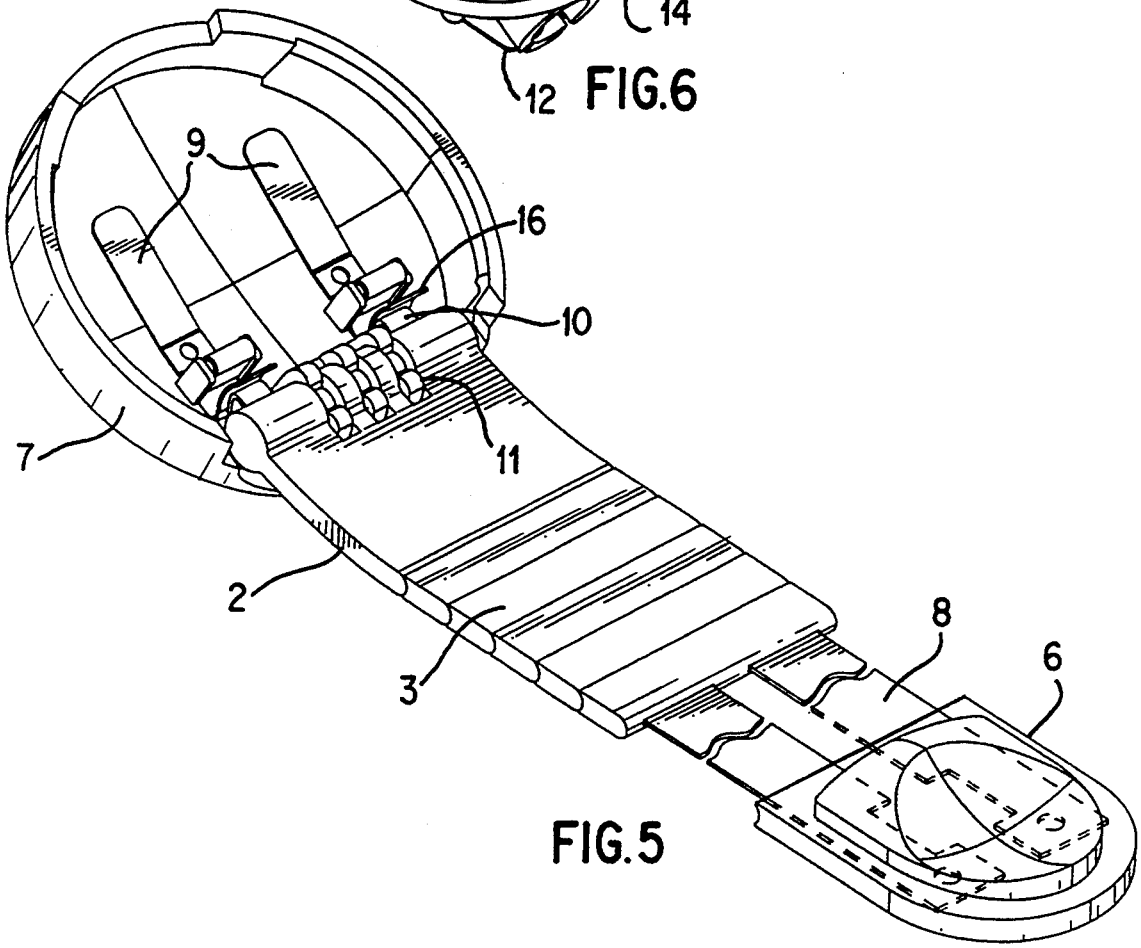
FIG. 5 is a perspective transparent view of the light-bearing neck showing the individual neck vertebrae and the head base assembly. The metal strips within the neck connect the battery pack to the lamp through the head base assembly when the neck is in the extended position.

FIG. 5 shows a perspective transparent view of the light-bearing neck 2 consisting of individual neck vertebrae 3 and the head base assembly 7. The metal strips 8 within the neck 2 are positioned to be in the middle and away from the edges of the neck and run along the entire length of the neck from the button 6 to the head base assembly 7 and serve as the electrical connection between the battery pack 5 and the lamp 4 when the neck 2 is in the extended position. The metal strips 8 extend out of the topmost vertebra in the neck and the extended end of the metal strips 10 makes electrical contact to the head contacts 9 through the sliding contacts 16. The passive switch contact is therefore formed between the spring-actuated contacts which connect via spring pressure to the contacts on the battery box, 21 and 22. The pivot 11 facilitates movement of the entire lamp assembly 4, and thus the direction and amount of light incident on any reading surface may be reasonably adjusted. The sliding contacts 16 ensure that electrical contact is maintained during any lamp pivoting action. FIG. 6 shows a perspective view of the compound parabolic reflector 29 and reflector and lamp cartridge assembly 14. When the bookmark is assembled the lamp 13 makes electrical connection to the head contacts 9 through the lamp contacts 12. The lamp and reflector assembly 14 shown in FIG. 6 is placed in the lamp head cover 15 shown in FIG. 7, and the lamp head cover 15 is then snapped onto the head base 7.

Figure 9:
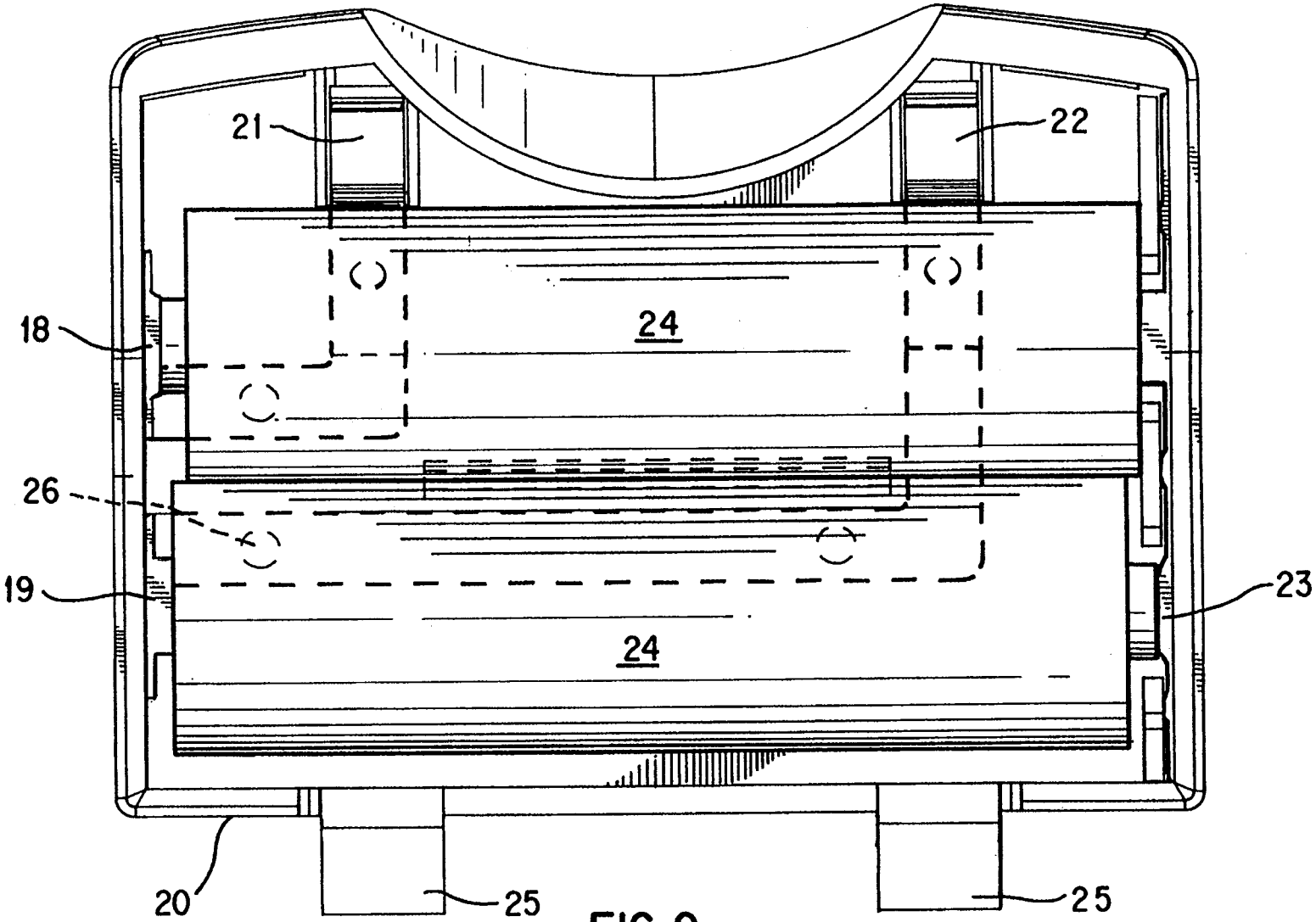
FIG. 9 is a front plan view of the battery assembly used in the present invention.

As shown in FIG. 9, the replaceable battery assembly used in the lighted bookmark is designed to operate with two commercial batteries 24. The entire battery pack housing 20 snaps onto the backside at the front end of the base 1 of the bookmark, as shown in FIGS. 3 and 4, through the snap bosses 25. The positive terminal 18 and the negative terminal 19 of the batteries 24 are internally connected up to the positive and negative battery contacts 21 and 22 respectively. In another embodiment, an AC power source, including a transformer in series between the snap-on portion and the wall plug, which snaps onto the unit in the same position as the removable battery pack may be used instead of the battery pack. The lamp is preferably a halogen bulb operating from two AA batteries.

A representative assembly sequence for the lighted bookmark would consist of the following steps: (a) Installing the base contacts to the base housing; (b) Sliding individual vertebrae onto the neck subassembly and securing them via the button at the end of the metal strips; (c) Placing the neck assembly onto the base housing and trapping it in place with the base cover housing; (d) Ultrasonically, or otherwise welding the base housing to the base cover housing, thus trapping the neck assembly in the groove provided for it in the base; (e) Installing the lamp into the compound parabolic reflector assembly; (f) Snapping the head contacts over the bosses in the head base; (g) Snapping the head base to the end of the neck protruding from the top of the base; (h) Placing the reflector and lamp assembly into the head cover and snapping the head cover onto the head base; (i) Installing three contacts into the battery pack; and (j) Snapping the battery pack onto the backside of the front of the base of the bookmark.

It will be appreciated that, although the invention has been set forth in considerable detail to describe the embodiments and advantages over prior art structures, such detailed description is not intended in any way to limit the broad features or principles of this invention, and accordingly, the appended claims should be construed broadly in a manner consistent with the spirit and scope of the invention herein.

What is claimed is:

1. A lighting device comprising:

(a) a base member;

(b) a neck member connected to said base member and comprising individual vertebrae segments strung together on longitudinal electrically conductive members, said neck member being capable of slideably moving from a first position in which said neck member is fully extended out of said base member to a second position wherein said neck member is positioned over said base member;

(c) light means located at top end of said neck member; and (d) said conductive neck members possessing a memory effect which returns said neck member substantially to a curved state in said first position when extended from said second position to said first position and forming at least part of an electrical path to said light means.

2. The lighting device as defined in claim 1 wherein said light means is capable of movement to adjust the amount and direction of light and said base member is slim and elongated with a narrow first end forming the bottom of a bookmark and a broader second end forming the top of said bookmark.

3. The lighting device as defined in claim 2 further comprising:

(a) a power source located at said second end of said base member; and (b) passive switch means in circuit between said power source and said light means for automatically energizing said light means when said neck member is in said first position and deenergizing said light means when said neck member is moved from said first position to said second position.

4. The lighting device as defined in claim 3 wherein the movement of said neck member from said first position to said second position is achieved by sliding a button connected to said neck member from said second end of said base member to said first end of said base member.

5. The lighting device as defined in claim 4 wherein said neck member is flat when positioned over said base member in said second position and is curved when fully extended to said first position.

6. The lighting device as defined in claim 5 wherein said conductive members comprise two metal members substantially in the middle of said neck member and providing electrical connection from said power source to said light means.

7. The lighting device as defined in claim 6 wherein at least one of said individual vertebrae segments in said neck member is exposed to permit said conductive members to make electrical contact to said passive switch means.

8. The lighting device as defined in claim 7 wherein said power source comprises a multiplicity of low voltage batteries with each said battery disposed between a pair of positive and negative terminals.

9. The lighting device as defined in claim 8 wherein said passive switch means further comprises spring actuated contacts to achieve electrical connection between said conductive members and said power source, when said neck member is fully extended, and thus functions to turn on said light means.

10. The lighting device as defined in claim 9 wherein said light means further comprises a lamp and a compound parabolic reflector with said lamp being in electrical contact to said conductive members.

11. The lighting device as defined in claim 10 wherein length of said base member is selected to match the length of any book.

12. The lighting device as defined in claim 11 wherein said base member is flat and is capable of being positioned on a page of a book.

13. The lighting device as defined in claim 6 wherein said metal members are made of pre-curved spring stainless steel.

* * * * *